US007997672B2

(12) United States Patent
Ito

(10) Patent No.: US 7,997,672 B2
(45) Date of Patent: Aug. 16, 2011

(54) INKJET RECORDING APPARATUS

(75) Inventor: Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1050 days.

(21) Appl. No.: 11/829,965

(22) Filed: Jul. 30, 2007

(65) Prior Publication Data

US 2008/0024535 A1 Jan. 31, 2008

(30) Foreign Application Priority Data

Jul. 31, 2006 (JP) ..... 2006-207501

(51) Int. Cl.
*B41J 29/38* (2006.01)

(52) U.S. Cl. ..... 347/11; 347/6; 347/10

(58) Field of Classification Search ..... None
See application file for complete search history.

(56) References Cited

U.S. PATENT DOCUMENTS

| | | | |
|---|---|---|---|
| 6,068,360 | A | 5/2000 | Hiwada |
| 6,945,627 | B2 | 9/2005 | Yamaguchi |
| 7,114,797 | B2 | 10/2006 | Junhua |
| 2005/0073542 | A1 | 4/2005 | Yoneyama |

FOREIGN PATENT DOCUMENTS

| | | | |
|---|---|---|---|
| JP | H63-174522 | A | 7/1988 |
| JP | S63-174522 | A | 7/1988 |
| JP | H03-164258 | A | 7/1991 |
| JP | H10-166558 | A | 6/1998 |
| JP | H10-1066558 | A | 6/1998 |
| JP | H11-20268 | A | 1/1999 |
| JP | 2002036568 | A | 2/2002 |
| JP | 2003-154647 | A | 5/2003 |
| JP | 2004-48985 | A | 2/2004 |
| JP | 2004-82718 | A | 3/2004 |
| JP | 2004082718 | * | 3/2004 |
| JP | 2005-041074 | A | 2/2005 |
| JP | 2005-104116 | A | 4/2005 |
| JP | 2006-076264 | A | 2/2006 |
| JP | 2006167506 | A | 6/2006 |

OTHER PUBLICATIONS

Japanese Office Action issued in corresponding Japanese Application No. 2006-207501, dated Jun. 24, 2008.

* cited by examiner

*Primary Examiner* — Uyen-Chau N Le
*Assistant Examiner* — Chad H Smith
(74) *Attorney, Agent, or Firm* — Baker Botts L.L.P.

(57) ABSTRACT

An inkjet recording apparatus includes a waveform outputting circuit and a current restricting circuit. The waveform outputting circuit outputs to each individual electrode one of ejection signals and a flushing signal, which does not cause any nozzle to eject ink droplets, selected in order in each printing cycle. The current restricting circuit restricts the value of a current to flow from a power supply unit into the waveform outputting circuit, to a value not more than an upper limit current value. The upper limit current value exceeds the value of the current to flow into the waveform outputting circuit when the waveform outputting circuit outputs to all individual electrodes an ejection signal corresponding to the largest amount of ink to eject. The upper limit current value is less than the value of the current to flow into the waveform outputting circuit when the waveform outputting circuit outputs the flushing signal to all individual electrodes.

6 Claims, 12 Drawing Sheets

INKJET RECORDING APPARATUS

CROSS REFERENCE TO RELATED APPLICATION

The present application claims priority from Japanese Patent Application No. 2006-207501, which was filed on Jul. 31, 2006, the disclosure of which is herein incorporated by reference in its entirely.

BACKGROUND OF THE INVENTION

1. Field of the Invention

The present invention relates to an inkjet recording apparatus in which ink droplets are ejected to print.

2. Description of Related Art

An inkjet head includes a passage unit in which there are formed nozzles to eject ink droplets and pressure chambers connected to the respective nozzles; and a piezoelectric actuator to give ejection energy to ink in each pressure chamber. The piezoelectric actuator changes the volume of each pressure chamber to apply pressure to ink in the pressure chamber. In an inkjet head disclosed in Japanese Patent Unexamined Publication No. 2002-36568, a piezoelectric actuator includes a piezoelectric layer disposed over a plurality of pressure chambers; a plurality of individual electrodes being opposed to the respective pressure chambers; and a common electrode being kept at a reference potential and opposed to the individual electrodes across the piezoelectric layer. In the piezoelectric actuator, when a voltage pulse signal is given to an individual electrode, electric field is impressed along the thickness of the piezoelectric layer to a portion of the piezoelectric layer being sandwiched by the individual electrode and the common electrode. The electric field elongates the thickness of the portion of the piezoelectric layer. Thereby, the volume of the corresponding pressure chamber is changed so that pressure is applied to ink in the pressure chamber.

In inkjet recording apparatuses, an increase in printing speed is desired. To increase printing speed, the ink ejection cycle of each nozzle must be shortened. When the ink ejection cycle is shortened, quick-drying ink must be used so that ink droplets having impacted a recording paper dry quickly. However, when such quick-drying ink is used, the viscosity of ink in each nozzle may increase by drying. This brings about deterioration of ink ejection performance or defective ejections. As a method for avoiding the above problem, So-called "ejection flushing" is known in which ink having increased in viscosity is ejected from each nozzle toward a place other than a printing paper. However, when ejection flushing is frequently performed, a considerable amount of ink is wastefully consumed.

For the above reason, in some cases, so-called "non-ejection flushing" or "dummy flushing" is performed by driving the actuator to the extent that any nozzle does not eject an ink droplet, and thereby agitating ink in each nozzle. The width of the pulse to be given to each individual electrode in non-ejection flushing, is smaller than the width of the pulse for allowing each nozzle to eject ink droplets. In non-ejection flushing, however, it is required to increase the number of drives of the actuator in comparison with ejection flushing. This increases the power consumption of the inkjet recording apparatus.

In another non-ejection flushing method than the above-described method, each individual electrode is given a level of a voltage pulse lower than the level for allowing each nozzle to eject ink droplets. In this method, however, a voltage control circuit is required to properly control the level of the voltage pulse to one of the two levels. This increases the manufacturing cost of the inkjet recording apparatus.

SUMMARY OF THE INVENTION

An object of the present invention is to provide an inkjet recording apparatus that can suppress deterioration of ink ejection performance and defective ejections, and realize power saving.

Another object of the present invention is to provide an inkjet recording apparatus that can suppress deterioration of ink ejection performance and defective ejections, and realize power saving and cost reduction.

According to the present invention, an inkjet recording apparatus comprises a conveyance mechanism which conveys a recoding medium; a passage unit including therein a plurality of individual ink passages each of which leads from an outlet of a common ink chamber through a pressure chamber to a nozzle; and an ejection energy applier which gives ejection energy to ink in a plurality of the pressure chambers of the passage unit. The applier includes a plurality of individual electrodes related to the respective pressure chambers. The apparatus further comprises a waveform outputting circuit which outputs to each individual electrode one of a plurality of ejection signals and a flushing signal selected in order in each printing cycle, which is defined by a time period necessary for conveying the printing medium by unit distance corresponding to a printing resolution of an image to be formed on the recording medium. The plurality of ejection signals contains the different numbers of voltage pulses to drive the ejection energy applier. The numbers of voltage pulses correspond to a plurality of amounts of ink to be ejected from each nozzle in one printing cycle, respectively. The flushing signal contains a plurality of voltage pulses each having a width smaller than that of any voltage pulse containing in the ejection signals, and arranged at smaller intervals than a plurality of voltage pulses containing in any ejection signals so that any nozzle does not eject an ink droplet. The apparatus further comprises a power supply unit which supplies power to the waveform outputting circuit; and a current restricting circuit which restricts a current to flow from the power supply unit into the waveform outputting circuit so that the value of the current to flow from the power supply unit into the waveform outputting circuit is not more than an upper limit current value which has been determined so as to exceed a value of the current to flow from the power supply unit into the waveform outputting circuit when the waveform outputting circuit outputs to all individual electrodes an ejection signal corresponding to the largest amount of ink to eject, and so as to be less than a value of the current to flow from the power supply unit into the waveform outputting circuit when the waveform outputting circuit outputs the flushing signal to all individual electrodes.

According to the invention, in non-ejection flushing, the waveform outputting circuit intends to output the flushing signal to all individual electrodes. The current restricting circuit then restricts the value of the current to flow from the power supply unit into the waveform outputting circuit, to a value not more than the upper limit current value. This suppresses deterioration of ink ejection performance and defective ejection, and realizes power saving of the inkjet recording apparatus.

According to another aspect of the present invention, an inkjet recording apparatus comprises a conveyance mechanism which conveys a recoding medium; a passage unit including therein a plurality of individual ink passages each of which leads from an outlet of a common ink chamber through a pressure chamber to a nozzle; and an ejection energy applier which gives ejection energy to ink in a plurality of the pressure chambers of the passage unit. The applier includes a plurality of individual electrodes related to the respective pressure chambers. The apparatus further comprises a waveform outputting circuit which outputs to each individual electrode one of a plurality of ejection signals selected in order in each printing cycle, which is defined by a time period necessary for conveying the printing medium by unit distance corresponding to a printing resolution of an image to be formed on the recording medium. The plurality of ejection signals contains the different numbers of voltage pulses to drive the ejection energy applier. The numbers of voltage pulses correspond to a plurality of amounts of ink to be ejected from each nozzle in one printing cycle, respectively. The apparatus further comprises a power supply unit which supplies power to the waveform outputting circuit; and a current restricting circuit which restricts a current to flow from the power supply unit into the waveform outputting circuit so that each voltage pulse contained in an ejection signal corresponding to the largest amount of ink to eject has a height by which the ejection energy applier is driven without any nozzle ejecting an ink droplet, when the waveform outputting circuit outputs the ejection signal to all individual electrodes. The waveform outputting circuit outputs to at least one individual electrode an ejection signal for ejecting the second largest or less amount of ink, when all nozzles eject one or more ink droplets in one printing cycle.

According to the invention, in non-ejection flushing, the waveform outputting circuit intends to output to all individual electrodes the ejection signal corresponding to the largest amount of ink to eject. The current restricting circuit then restricts the current to flow into the waveform outputting circuit, so that each voltage pulse contained in the ejection signal has a height by which the ejection energy applier is driven without any nozzle ejecting an ink droplet. Because the current restricting circuit thus restricts the current to flow from the power supply unit into the waveform outputting circuit, this suppresses deterioration of ink ejection performance and defective ejection, and realizes power saving of the inkjet recording apparatus. In addition, because there is no necessity to provide a voltage control circuit for controlling the height of each voltage pulse, and a waveform generating circuit for generating a waveform for non-ejection flushing, this realizes a cost reduction of the inkjet recording apparatus.

According to still another aspect of the present invention, an inkjet recording apparatus comprises a conveyance mechanism which conveys a recoding medium; and a passage unit positioned so as to be opposed to the recording medium being conveyed by the conveyance mechanism. The passage unit extends perpendicularly to a conveyance direction of the printing medium. The passage unit includes therein a plurality of individual ink passages each of which leads from an outlet of a common ink chamber through a pressure chamber to a nozzle. The passage unit has an ink ejection face where a plurality of nozzles are open. The ink ejection face has an ejection region in which a plurality of nozzles are arranged longitudinally of the ink ejection face at regular intervals, and non-ejection regions in each of which a plurality of nozzles are arranged longitudinally of the ink ejection face at irregular intervals. The non-ejection regions neighbor the ejection region on both sides of the ejection region longitudinally of the ink ejection face. The apparatus further comprises an ejection energy applier which gives ejection energy to ink in a plurality of the pressure chambers of the passage unit. The applier includes a plurality of individual electrodes related to the respective pressure chambers. The apparatus further comprises a waveform outputting circuit which outputs to each individual electrode one of a plurality of ejection signals selected in order in each printing cycle, which is defined by a time period necessary for conveying the printing medium by unit distance corresponding to a printing resolution of an image to be formed on the recording medium. The plurality of ejection signals contains the different numbers of voltage pulses to drive the ejection energy applier. The numbers of voltage pulses correspond to a plurality of amounts of ink to be ejected from each nozzle in one printing cycle, respectively. The apparatus further comprises a power supply unit which supplies power to the waveform outputting circuit; and a current restricting circuit which restricts a current to flow from the power supply unit into the waveform outputting circuit so that each voltage pulse contained in an ejection signal corresponding to the largest amount of ink to eject has a height by which the ejection energy applier is driven without any nozzle ejecting an ink droplet, when the waveform outputting circuit outputs the ejection signal to all individual electrodes in the ejection region and at least one individual electrode in the non-ejection regions.

According to the invention, in non-ejection flushing, the waveform outputting circuit intends to output the ejection signal corresponding to the largest amount of ink to eject, to all individual electrodes in the ejection region and at least one individual electrode in the non-ejection regions. The current restricting circuit then restricts the current to flow into the waveform outputting circuit, so that each voltage pulse contained in the ejection signal has a height by which the ejection energy applier is driven without any nozzle ejecting an ink droplet. Because the current restricting circuit thus restricts the current to flow from the power supply unit into the waveform outputting circuit, this suppresses deterioration of ink ejection performance and defective ejection, and realizes power saving of the inkjet recording apparatus. In addition, because there is no necessity to provide a voltage control circuit for controlling the height of each voltage pulse, and a waveform generating circuit for generating a waveform for non-ejection flushing, this realizes a cost reduction of the inkjet recording apparatus.

According to still another aspect of the present invention, an inkjet recording apparatus comprises a conveyance mechanism which conveys a recoding medium; a passage unit including therein a plurality of individual ink passages each of which leads from an outlet of a common ink chamber through a pressure chamber to a nozzle; and an ejection energy applier which gives ejection energy to ink in a plurality of the pressure chambers of the passage unit. The applier includes a plurality of individual electrodes related to the respective pressure chambers. The apparatus further comprises a waveform outputting circuit which outputs to each individual electrode one of a plurality of ejection signals and a flushing signal selected in order in each printing cycle, which is defined by a time period necessary for conveying the printing medium by unit distance corresponding to a printing resolution of an image to be formed on the recording medium. The plurality of ejection signals contains the different numbers of voltage pulses to drive the ejection energy applier. The numbers of voltage pulses correspond to a plurality of amounts of ink to be ejected from each nozzle in one printing cycle, respectively. The flushing signal contains a plurality of voltage pulses each having a width smaller than that of any voltage pulse containing in the ejection signals, and arranged at smaller intervals than a plurality of voltage pulses containing in any ejection signals so that any nozzle does not eject an ink droplet. The apparatus further comprises a power line through which power is supplied to the waveform outputting circuit. The power line has an internal resistance such that each voltage pulse contained in the flushing signal has a height by which the ejection energy applier is driven without any nozzle ejecting an ink droplet, when the waveform outputting circuit outputs the flushing signal to all individual electrodes.

According to still another aspect of the present invention, an inkjet recording apparatus comprises a conveyance mechanism which conveys a recoding medium; a passage unit including therein a plurality of individual ink passages each of which leads from an outlet of a common ink chamber through a pressure chamber to a nozzle; and an ejection energy applier which gives ejection energy to ink in a plurality of the pressure chambers of the passage unit. The applier includes a plurality of individual electrodes related to the respective pressure chambers. The apparatus further comprises a waveform outputting circuit which outputs to each individual electrode one of a plurality of ejection signals selected in order in each printing cycle, which is defined by a time period necessary for conveying the printing medium by unit distance corresponding to a printing resolution of an image to be formed on the recording medium. The plurality of ejection signals contains the different numbers of voltage pulses to drive the ejection energy applier. The numbers of voltage pulses correspond to a plurality of amounts of ink to be ejected from each nozzle in one printing cycle, respectively. The apparatus further comprises a power line through which power is supplied to the waveform outputting circuit. The power line has an internal resistance such that each voltage pulse contained in an ejection signal corresponding to the largest amount of ink to eject has a height by which the ejection energy applier is driven without any nozzle ejecting an ink droplet, when the waveform outputting circuit outputs the ejection signal to all individual electrodes in one printing cycle. The waveform outputting circuit outputs to at least one individual electrode an ejection signal for ejecting the second largest or less amount of ink, when all nozzles eject one or more ink droplets in one printing cycle.

According to still another aspect of the present invention, an inkjet recording apparatus comprises a conveyance mechanism which conveys a recoding medium; and a passage unit positioned so as to be opposed to the recording medium being conveyed by the conveyance mechanism. The passage unit extends perpendicularly to a conveyance direction of the printing medium. The passage unit includes therein a plurality of individual ink passages each of which leads from an outlet of a common ink chamber through a pressure chamber to a nozzle. The passage unit has an ink ejection face where a plurality of nozzles are open. The ink ejection face has an ejection region in which a plurality of nozzles are arranged longitudinally of the ink ejection face at regular intervals, and non-ejection regions in each of which a plurality of nozzles are arranged longitudinally of the ink ejection face at irregular intervals. The non-ejection regions neighbor the ejection region on both sides of the ejection region longitudinally of the ink ejection face. The apparatus further comprises an ejection energy applier which gives ejection energy to ink in a plurality of the pressure chambers of the passage unit. The applier includes a plurality of individual electrodes related to the respective pressure chambers. The apparatus further comprises a waveform outputting circuit which outputs to each individual electrode one of a plurality of ejection signals selected in order in each printing cycle, which is defined by a time period necessary for conveying the printing medium by unit distance corresponding to a printing resolution of an image to be formed on the recording medium. The plurality of ejection signals contains the different numbers of voltage pulses to drive the ejection energy applier. The numbers of voltage pulses correspond to a plurality of amounts of ink to be ejected from each nozzle in one printing cycle, respectively. The apparatus further comprises a power line through which power is supplied to the waveform outputting circuit. The power line has an internal resistance such that each voltage pulse contained in an ejection signal corresponding to the largest amount of ink to eject has a height by which the ejection energy applier is driven without any nozzle ejecting an ink droplet, when the waveform outputting circuit outputs the ejection signal to all individual electrodes in the ejection region and at least one individual electrode in the non-ejection regions.

According to the invention, in non-ejection flushing, the internal resistance of the power line causes each voltage pulse contained in the ejection signal to have a height by which the ejection energy applier is driven without any nozzle ejecting an ink droplet. Because the internal resistance of the power line thus lowers the height of each voltage pulse in non-ejection flushing, this suppresses deterioration of ink ejection performance and defective ejection, and realizes power saving of the inkjet recording apparatus. In addition, because there is no necessity to provide a voltage control circuit for controlling the height of each voltage pulse, and a waveform generating circuit for generating a waveform for non-ejection flushing, this realizes a cost reduction of the inkjet recording apparatus.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

First Embodiment

Figure 1:
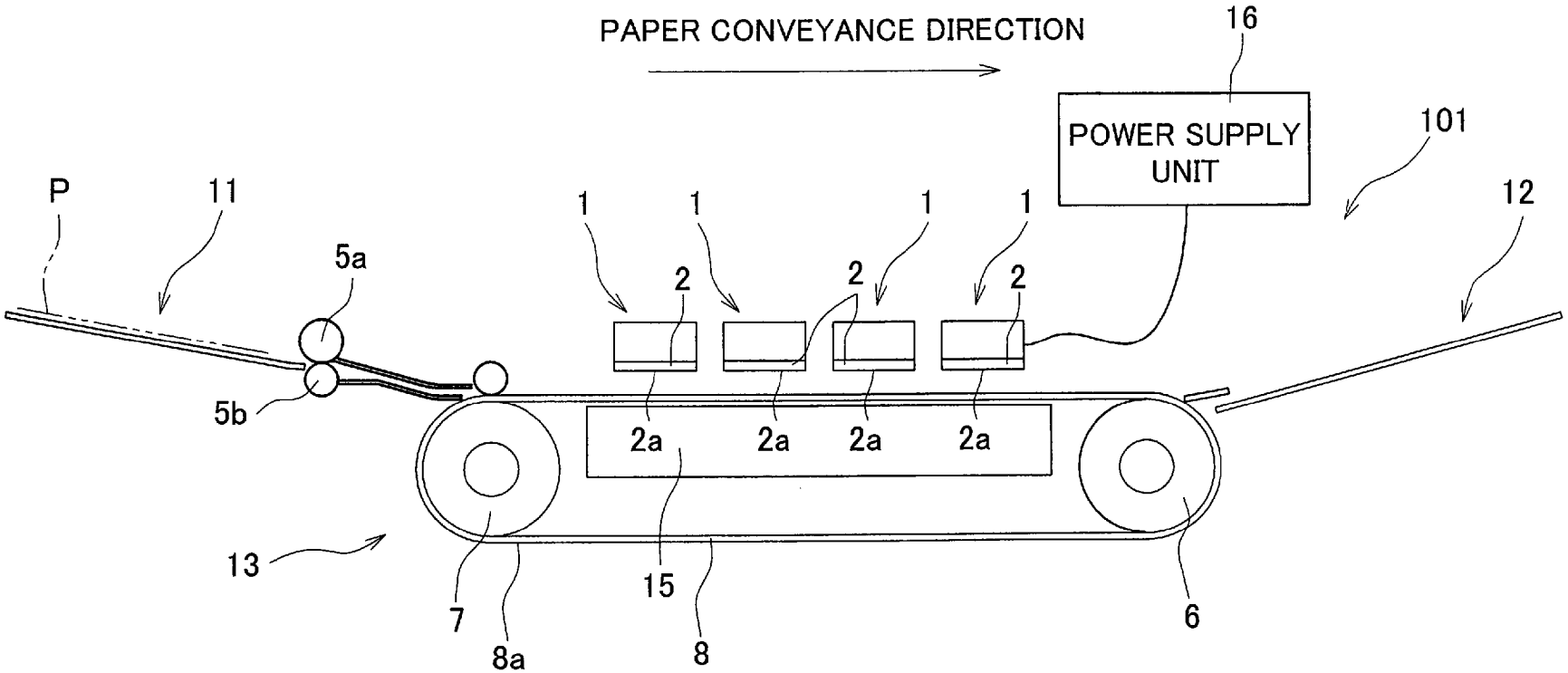
FIG. 1 is a schematic side view of an inkjet printer according to a first embodiment of the present invention.

As shown in FIG. 1, an inkjet printer 101 according to a first embodiment of the present invention is a color inkjet printer having four inkjet heads 1 for ejecting ink of four different colors of magenta, yellow, cyan, and black, respectively. Each inkjet head 1 extends perpendicularly to FIG. 1. The four inkjet heads 1 are fixedly arranged in a paper conveyance direction shown by an arrow. Thus, the inkjet printer 101 is a line type printer. The inkjet printer 101 includes a power supply unit 16 that supplies power to each inkjet head 1. The inkjet printer 101 further includes a paper feed tray 11 and a paper discharge tray 12.

In the inkjet printer 101 provided is a paper conveyance path on which a paper P as a recording medium is conveyed from the paper feed tray 11 toward the paper discharge tray 12. A pair of feed rollers 5*a* and 5*b* for pinching the paper to convey are disposed immediately downstream of the paper feed tray 11. The pair of feed rollers 5*a* and 5*b* send the paper P rightward in FIG. 1 from the paper feed tray 11. The paper P sent by the feed rollers 5*a* and 5*b* is fed onto a belt conveyor mechanism 13. The belt conveyor mechanism 13 includes two belt rollers 6 and 7; an endless conveyor belt 8 wrapped on the rollers 6 and 7 to be stretched between the rollers 6 and 7; and a platen 15 disposed in a region surrounded by the conveyor belt 8 so as to be opposed to the four inkjet heads 1.

When a not-shown conveyance motor drives the belt roller 6 to rotate clockwise, the conveyor belt 8 rotates clockwise. Thereby, the conveyor belt 8 conveys toward the paper discharge tray 12 the paper p that is kept on the conveyor belt 8 by being pressed on the adhesive outer circumferential surface 8*a* of the conveyor belt 8.

Each inkjet head 1 has at its lower end a head main body 2. Each head main body 2 has a rectangular parallelepiped shape extending perpendicularly to the conveyance direction. The bottom face of each head main body 2 is formed into an ink ejection face 2*a* being opposed to the outer circumferential surface 8*a* of the conveyor belt 8. When the paper P being conveyed by the conveyor belt 8 passes immediately below the four head main bodies in sequence, each ink ejection face 2*a* ejects ink droplets toward the upper surface, that is, the printing surface, of the paper P. Thereby, a desired color image is formed on the paper P.

Figure 2:
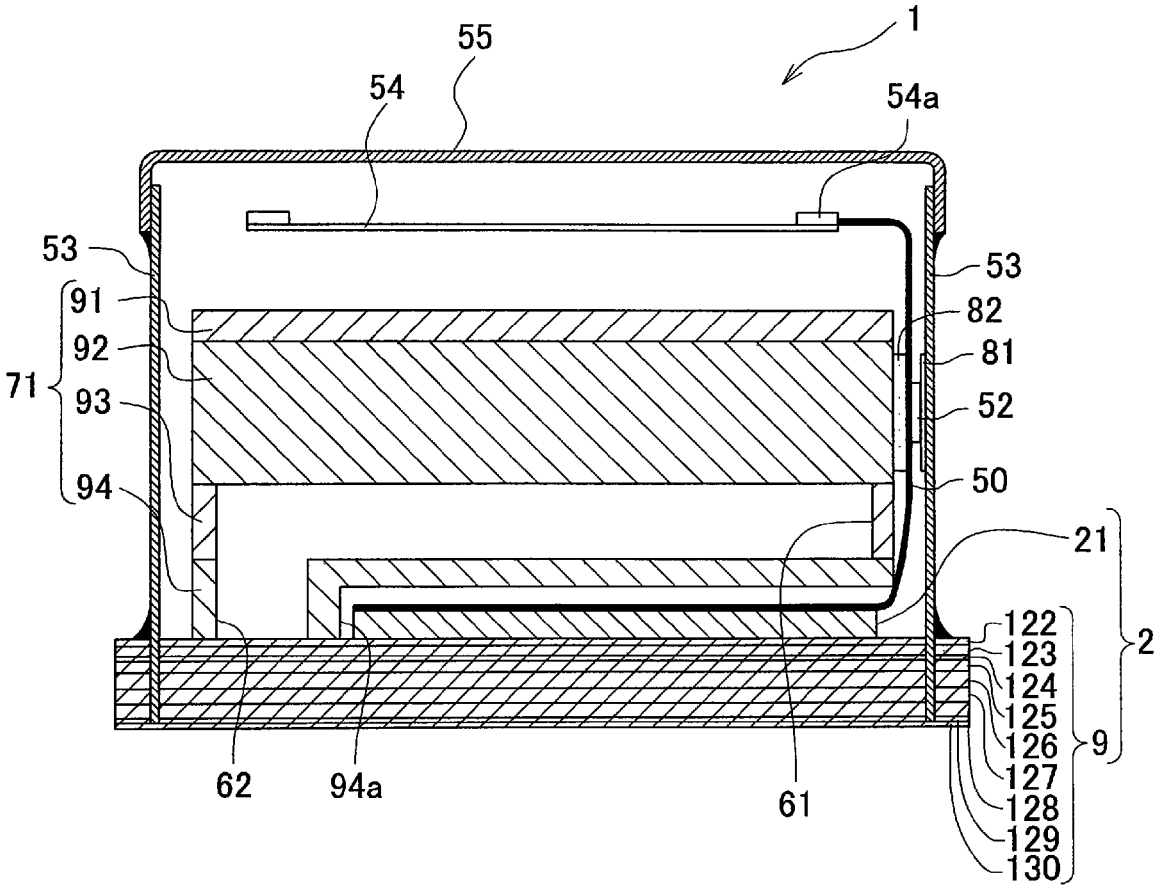
FIG. 2 is a lateral sectional view of an inkjet head shown in FIG. 1.

Next will be described a construction of each inkjet head 1. As shown in FIG. 2, each inkjet head 1 includes a head main body 2 including a passage unit 9 and actuator units 21; a reservoir unit 71; a chip-on-film (COF) 50; a circuit board 54; side covers 53, and a head cover 55. The reservoir unit 71 is disposed on the upper face of the head main body 2 to supply ink into the head main body 2. A driver IC 52 is mounted on a surface of the COF 50. The driver IC 52 includes a waveform output circuit that generates a voltage pulse to drive each actuator unit 21. Electric circuits formed on the circuit board 54 are electrically connected to each actuator unit 21 through the COF 50. The side covers 53, the head cover 55, and the passage unit 9 form a space that contains the actuator units 21, the reservoir unit 71, the COF 50, and the circuit board 54. The side covers 53 and the head cover 55 prevent external ink from entering the space.

Figure 3:
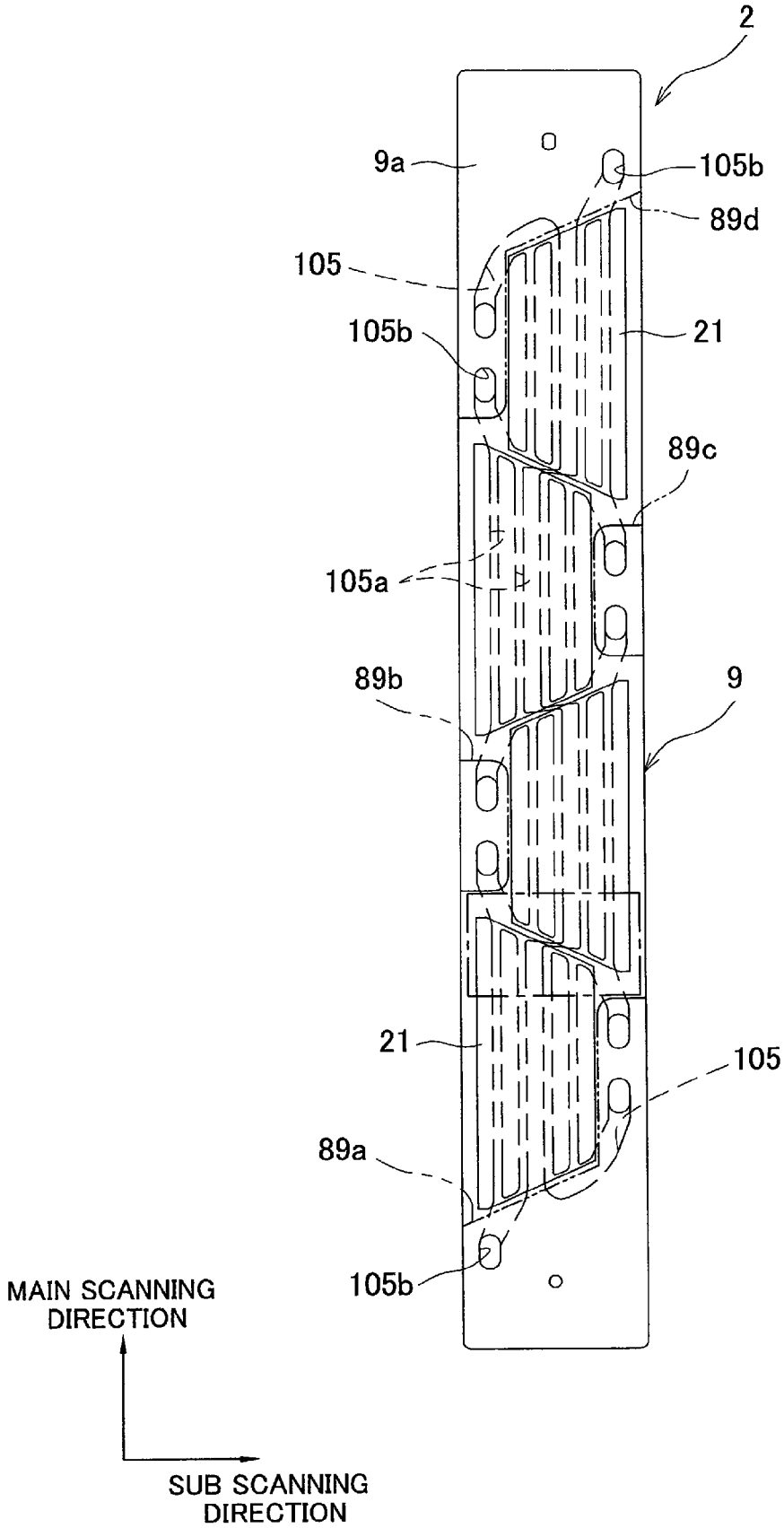
FIG. 3 is a plan view of a head main body shown in FIG. 2.

The reservoir unit 71 includes four plates 91 to 94 put in layers. In the reservoir unit 71 formed are a not-shown ink flow-in passage, an ink reservoir 61, and ten ink flow-out passages 62. FIG. 2 shows only one ink flow-out passage 62. When ink flows in the ink flow-in passage from a not-shown ink tank, the ink flows out from the ten ink flow-out passages 62 via the ink reservoir 61. Each ink flow-out passage 62 is connected to the interior of the passage unit 9 through an ink supply port 105*b*, as shown in FIG. 3, formed on the upper face of the passage unit 9. Thus, ink supplied from the ink tank into the reservoir unit 71 passes through the ink flow-in passage, the ink reservoir 61, and the ink flow-out passages 62 The ink is then supplied through each ink supply port 105*b* into the passage unit 9.

A recess 94*a* is formed on the lower face of the plate 94. The recess 94*a* of the plate 94 forms a space between the plate 94 and the passage unit 9. Each actuator unit 21 is disposed in the space.

A portion of the COF 50 near its lower end is bonded onto the upper surface of each actuator unit 21 so that not-shown wires formed on the surface of the COF 50 are electrically connected to individual electrodes 135 and a common electrode 134, which will be described later. The COF 50 extends upward from the upper surface from each actuator unit 21 to pass between one side cover 53 and the reservoir unit 71. The upper end of the COF 50 is connected to a connector 54*a* fixed on the circuit board 54. The driver IC 52 mounted on the COF 50 is biased toward the side cover 53 by a sponge 82 attached to a side face of the reservoir unit 71. The driver IC 52 is thermally connected to the side cover 53 by being pressed to the inner surface of the side cover 53 across a heat discharge sheet 81. Thus, heats generated in the driver IC 52 are easily discharged to the exterior through the side cover 53.

On the basis of an instruction from a not-shown upper-rank controller, an electric circuit formed on the circuit board 54 outputs a signal containing a voltage pulse, in this embodiment, an ejection signal or a flushing signal, to each actuator unit 21 via the COF 50 to control the drive of the actuator unit 21.

Figure 4:
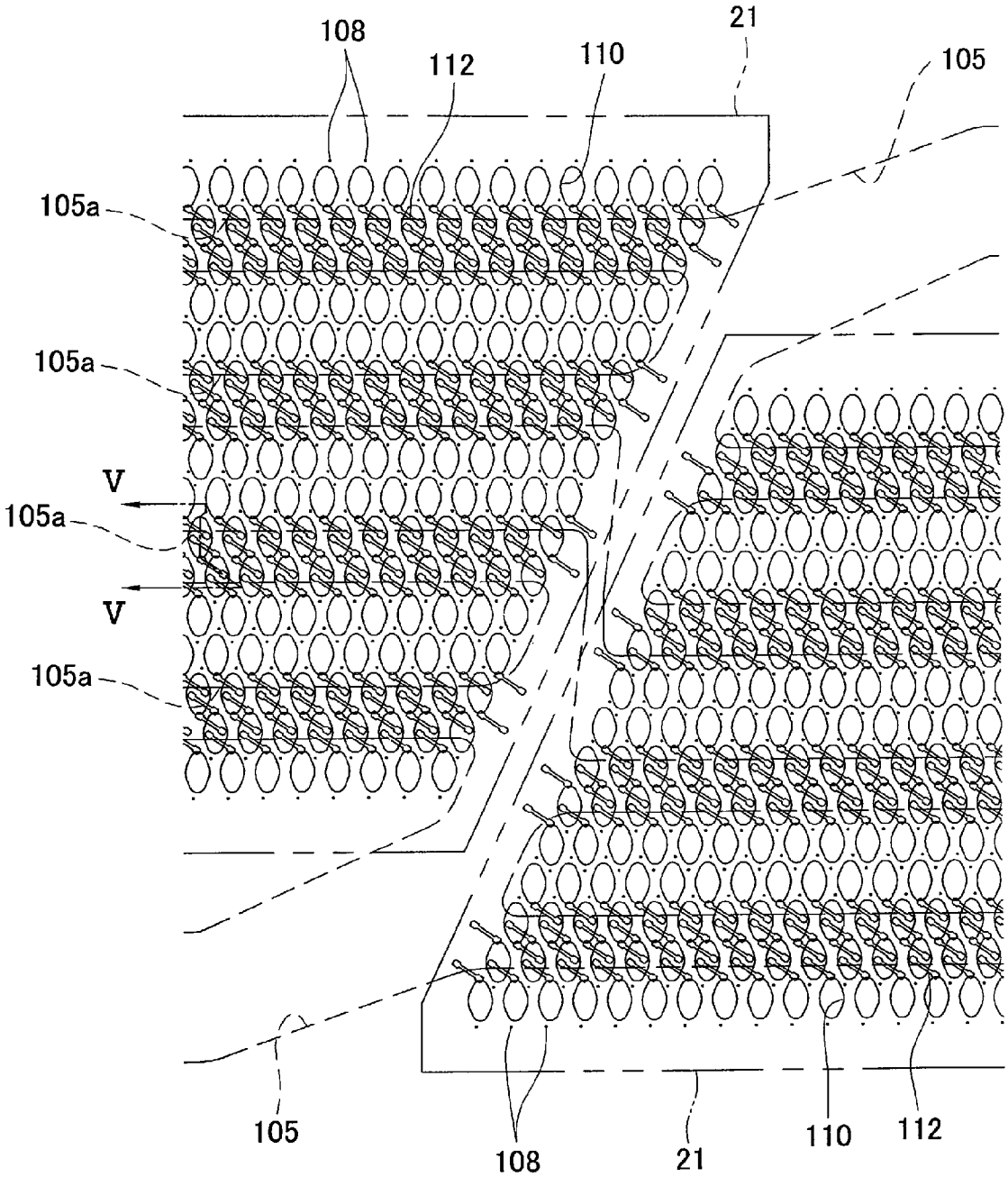
FIG. 4 is an enlarged view of a region enclosed with an alternate long and short dash line in FIG. 3.

Next, each head main body 2 will be described with reference to FIGS. 3 to 6. In FIG. 4, for making it easy to understand, each actuator unit 21 is shown by an alternate long and two short dashes line though it should be shown by a solid line. In addition, each pressure chamber 4 and each aperture 12 are shown by solid lines though they should be shown by broken lines because they are behind the corresponding actuator unit 21.

Figure 6A:
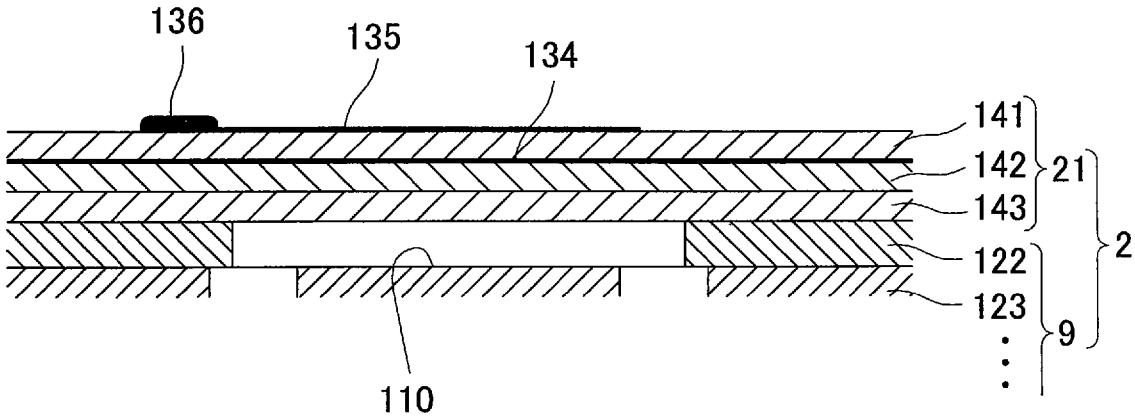
FIG. 6A is an enlarged sectional view of an actuator unit shown in FIG. 3.

As shown in FIG. 3, each head main body 2 includes a passage unit 9 and four actuator units 21 fixed to the upper face 9*a* of the passage unit 9. As shown in FIG. 4, each actuator unit 21 includes a plurality of individual electrodes 135, as shown in FIG. 6A, disposed so as to be opposed to respective pressure chambers 110 formed in the passage unit 9. The actuator unit 21 has a function of selectively giving ejection energy to ink in each pressure chamber 110.

Figure 5:
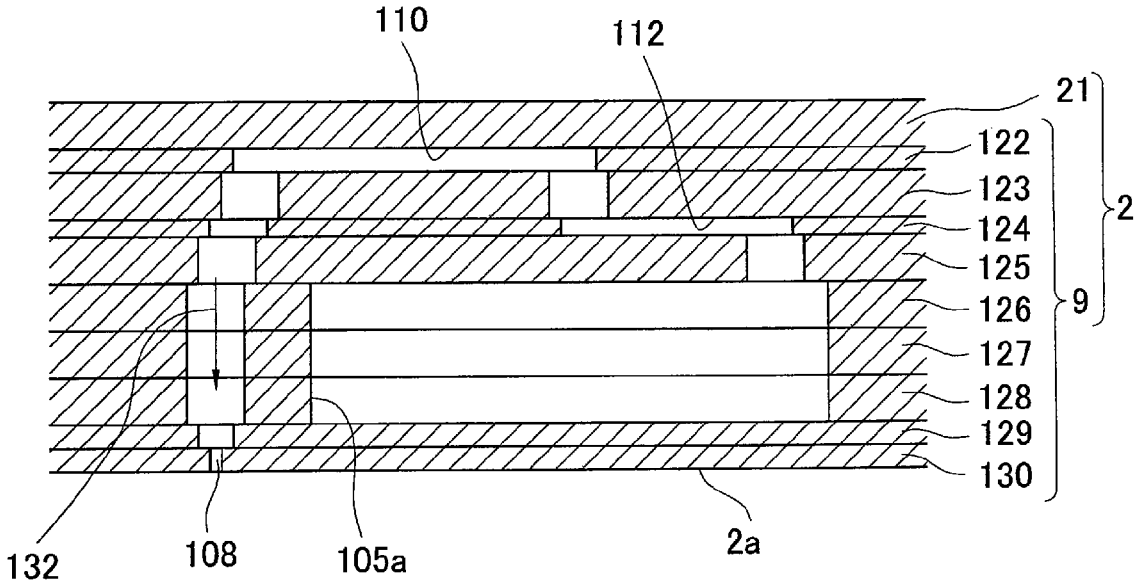
FIG. 5 is a sectional view taken along line V-V in FIG. 4.

Ten ink supply ports 105*b* in total are open at the upper face 9*a* of the passage unit 9 so as to correspond to the respective ink flow-out passages 62 of the reservoir unit 71. In the passage unit 9 formed are a plurality of manifold passages 105 each having its one end at the corresponding ink supply port 105*b*, and a plurality of sub manifold passages 105*a* branching from each manifold passage 105. As shown in FIGS. 4 and 5, the lower face of the passage unit 9 is formed into an ink ejection face 2*a* where a plurality of ejection ports 108 as openings of respective nozzles are regularly arranged in a matrix. In the upper face of the passage unit 9, a plurality of pressure chambers 110 are regularly arranged in a matrix.

As shown in FIG. 5, the passage unit 9 is made up of nine metallic plates of a cavity plate 122, a base plate 123, an aperture plate 124, a supply plate 125, three manifold plates 126, 127, and 128, a cover plate 129, and a nozzle plate 130, in the order from the upper side. Each of the nine plates 122 to 130 has a rectangular shape in a plan view extending in a main scanning direction.

The nine plates 122 to 130 are put in layers with being positioned to each other. Thereby, a plurality of individual ink passages 132 each leading from the outlet of a sub manifold passage 5*a* through a pressure chamber 10 to the ejection port 108 of a nozzle are formed in the passage unit 9. Ink supplied from the reservoir unit 71 through each ink supply port 105*b* into the passage unit 9 flows through each manifold passage 105 into each sub manifold passage 105*a*. Ink in the sub manifold passage 105*a* flows into an individual ink passage 132; and flows in the corresponding aperture 112, which functions as a throttle, and the corresponding pressure chamber 110; and then reaches the ejection port 108 of the corresponding nozzle.

Next will be described the actuator units 21. As shown in FIG. 3, each of the four actuator units 21 has a trapezoidal shape in a plan view. The actuator units 21 are arranged zigzag longitudinally of the passage unit 9 so as to avoid the ink supply ports 105*b*. The opposite parallel sides of each actuator unit 21 extend longitudinally of the passage unit 9. The oblique sides of neighboring actuator units 21 overlap each other longitudinally of the passage unit 9, that is, in the main scanning direction.

Figure 6B:
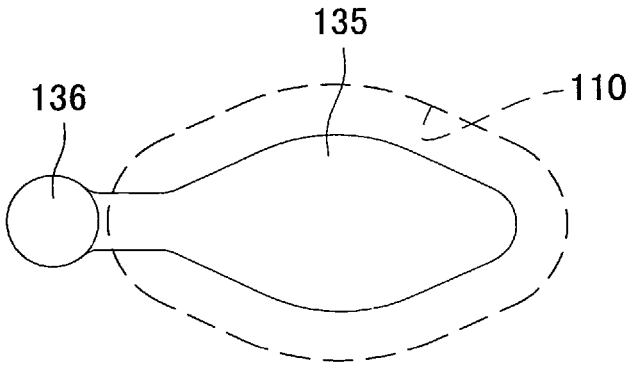
FIG. 6B is a plan view of an individual electrode disposed on the upper surface of the actuator unit.

As shown in FIG. 6A, each actuator unit 21 includes three piezoelectric layers 141 to 143 each made of a piezoelectric zirconate titanate (PZT)-base ceramic material having ferroelectricity. An individual electrode 135 is provided on the uppermost piezoelectric layer 141 in a region opposed to each pressure chamber 110. A common electrode 134 is interposed between the uppermost piezoelectric layer 141 and the second uppermost piezoelectric layer 142 over the whole area. As shown in FIG. 6B, each individual electrode 135 has a substantially rhombic shape in a plan view similar to each pressure chamber 110. One acute portion of each individual electrode 135 is extended out of the corresponding pressure chamber 110. A circular land 136 electrically connected to the individual electrode 135 is provided on the front end of the extension of the individual electrode 135.

A ground potential as a reference potential is given to the common electrode 134 through the corresponding COF 50. Each individual electrode 135 is electrically connected to a terminal provided on the corresponding driver IC 52 via the corresponding land 136 and an internal wire of the corresponding COF 50. As will be described later, an ejection signal or a flushing signal to drive each actuator unit 21 is supplied independently of each other from the corresponding driver IC 52 to each individual electrode 135 on the actuator unit 21. In the actuator unit 21, therefore, a portion sandwiched by each individual electrode 135 and the corresponding pressure chamber 110 acts as an individual actuator independent from each other. Thus, in the actuator unit 21, the same number of actuators as the pressure chambers are constructed.

Next will be described a driving method of an actuator unit 21 for making each nozzle eject ink droplets. The piezoelectric layer 141 has been polarized along the thickness of the piezoelectric layer 141. When an individual electrode 135 is put at a potential different from that of the common electrode 134 to impose electric field along the polarization, the portion of the piezoelectric layer 141 to which the electric field is imposed acts as an active portion that becomes distorted by the piezoelectric effect. When the electric field is imposed in the same direction as the polarization, the active portion elongates in thickness and laterally constricts. At this time, the quantity of displacement due to the lateral constriction is larger than the quantity of displacement due to the elongation in thickness. That is, in the actuator unit 21, the upper one piezoelectric layer 141 far from each pressure chamber 110 includes active portions, and the lower two piezoelectric layers 142 and 143 near each pressure chamber 110 are inactive layers. As shown in FIG. 6A, the piezoelectric layer 143 is fixed to the upper face of the cavity plate 122 that defines each pressure chamber 110. Therefore, when a difference in lateral distortion is produced between the portion of the piezoelectric layer 141 to which the electric field has been imposed, and the piezoelectric layers 142 and 143 below the piezoelectric layer 141, the whole of the piezoelectric layers 141 to 143 is unimorph-deformed so as to be convex toward the corresponding pressure chamber 110. Thereby, pressure, that is, ejection energy, is given to ink in the pressure chamber 110, and a pressure wave is generated in the pressure chamber 110. The generated pressure wave propagates from the pressure chamber 110 to the ejection port 108 of the corresponding nozzle so that ink droplets are ejected from the nozzle 108.

Figure 7A:
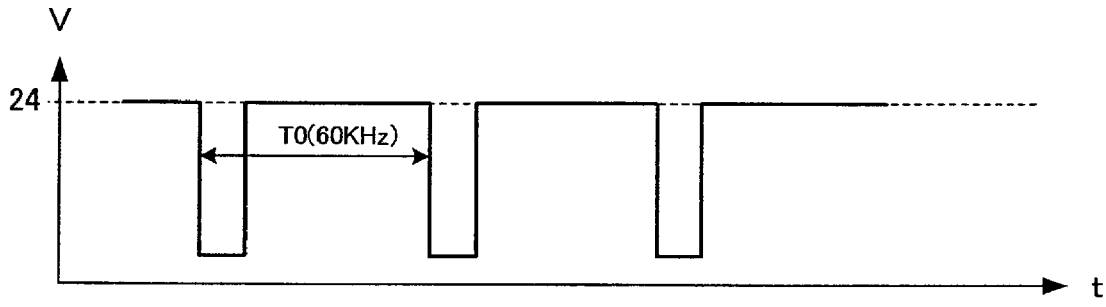
FIG. 7A is a timing chart showing an example of an ejection signal that a driver IC shown in FIG. 2 intends to output.

In this embodiment, each driver IC 52 outputs an ejection signal containing one or more voltage pulses so that each individual electrode 135 is given a predetermined potential in advance; the ground potential is once given to an individual electrode 135 at each time when receiving an ejection request; and then the predetermined potential is again given to the individual electrode 135 at a predetermined timing. In this case, at the timing when the individual electrode 135 becomes the ground potential, the pressure of ink in the corresponding pressure chamber 110 decreases so that ink is sucked from the corresponding sub manifold passage 105*a* into the corresponding individual ink passage 132. Afterward, at the timing when the individual electrode 135 again becomes the predetermined potential, the pressure of ink in the pressure chamber 110 increases so that ink droplets are ejected from the corresponding ejection port 108. The width of the voltage pulse to be given to the individual electrode 135 corresponds to an acoustic length (AL) that is a time length in which the pressure wave generated in the pressure chamber 110 propagates from the outlet of the sub manifold passage 105*a* to the ejection port 108. Because the width of the voltage pulse contained in the ejection signal is set to the above value, the reflected wave as a positive pressure and a positive pressure generated due to a new voltage pulse are superimposed in the pressure chamber 110. Therefore, ink droplets can be ejected from the ejection port 108 by a high pressure. In this embodiment, the predetermined potential is +24 V, as shown in FIG. 7A.

To drive the actuator unit 21 such that a nozzle does not eject ink droplets, the corresponding individual electrode 135 is given a flushing signal containing a plurality of voltage pulses lower in level than the voltage pulses contained in the ejection signal. Details of the flushing signal will be described later.

Because quick-drying ink is used in the inkjet printer 101, ink droplets having impacted a paper P dry quickly. Thus, even when printed papers are stacked on the paper discharge tray 12, ink is hard to transfer onto another paper. This can shorten the ejection cycle of ink droplets and realize high-speed printing. On the other hand, when such quick-drying ink is used, ink in each nozzle is apt to dry and easy to increase in viscosity. An increase in the viscosity of ink in each nozzle may bring about deterioration of ink ejection performance or defective ejections. For this reason, in the inkjet printer 101, there are selectively performed normal printing of ejecting ink droplets from each ejection port 108, and non-ejection flushing of oscillating the meniscus of ink formed in each ejection port 108, and thereby agitating ink in the nozzle without being ejected.

Normal printing is performed when a not-shown paper sensor detects a paper P being opposed to the ink ejection faces 2*a* of the inkjet heads 1. Non-ejection flushing is performed when the paper sensor detects no paper P being opposed to the ink ejection faces 2*a* of the inkjet heads 1.

Next will be described the waveforms of an ejection signal and a flushing signal that a driver IC 52 intends to output. FIG. 7A shows an example of an ejection signal in one printing cycle that the driver IC 52 intends to output. The printing cycle is a time period necessary for conveying a paper P by unit distance corresponding to the printing resolution in the conveyance direction of an image to be formed on the paper P, in this embodiment, 600 dpi. An ejection signal contains a plurality of voltage pulses in accordance with the number of ink droplets to be ejected from an ejection port 108 in one printing cycle. The tone of each dot constituting the image formed on the paper P is represented by the amount of ejected ink that is controlled by the number of ink droplets ejected from an ejection port 108 in one printing cycle. Therefore, a plurality of ejection signals exist that differ in the number of voltage pulses in accordance with the amount of ink ejected from an ejection port 108 in one printing cycle. In this embodiment, because the number of ink droplets to be ejected from each ejection port 108 in one printing cycle is one, two, or three, three kinds of ejection signals in total exist, that is, four kinds of ejection signals exist when an ejection signal for non-ejection is included. FIG. 7A shows an ejection signal for ejecting three ink droplets from an ejection port 108 in one printing cycle. Ejection signals for ejecting two or one ink droplet are obtained by reducing the number of low-level voltage pulses in the ejection signal shown in FIG. 7A to two or one, respectively.

Figure 7B:
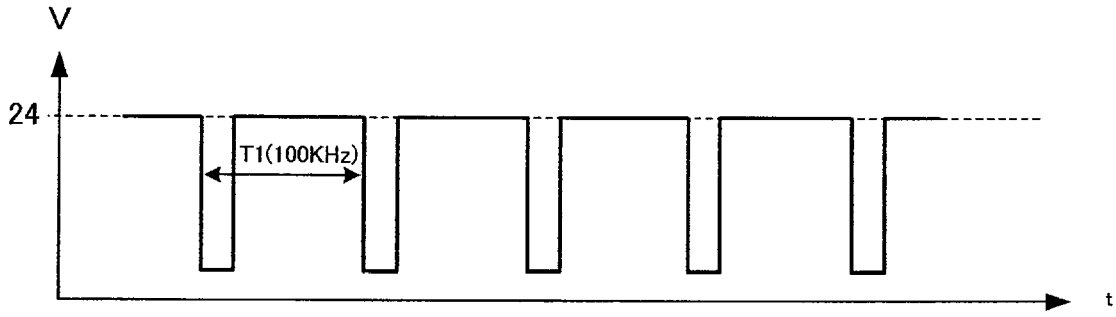
FIG. 7B is a timing chart showing a flushing signal that the driver IC intends to output.

FIG. 7B shows an example of a flushing signal that the driver IC 52 intends to output. In the flushing signal arranged are voltage pulses larger in number than the voltage pulses contained in any ejection signal in one printing cycle. The width of each voltage pulse contained in the flushing signal is smaller than the width of each voltage pulse contained in the ejection signal. That is, the width of each voltage pulse contained in the flushing signal is less than AL. Further, the cycle T1, the frequency corresponding to which is 100 kHz, of the voltage pulses contained in the flushing signal is shorter than the cycle T0, the frequency corresponding to which is 60 kHz, of the voltage pulses contained in the ejection signal. That is, each interval between the voltage pulses contained in the flushing signal is shorter than each interval between the voltage pulses contained in the ejection signal. Therefore, when the flushing signal is given to an individual electrode 135, the reflected wave as a positive pressure and a positive pressure generated due to a new voltage pulse are cancelled by each other in the corresponding pressure chamber 110, and as a result, no ink droplet is ejected from the corresponding ejection port 108.

On the basis of an instruction from a circuit on the circuit board 54, the driver IC 52 outputs to each individual electrode 135 one of the four kinds of ejection signals and the flushing signal sequentially selected in each printing cycle.

As shown in FIG. 7B, the height of each voltage pulse contained in the flushing signal that the driver IC 52 intends to output is 24 V, which is equal to the height of each voltage pulse contained in the ejection signal. In addition, the cycle T1 of the voltage pulses contained in the flushing signal is shorter than the cycle T0 of the voltage pulses contained in the ejection signal. Therefore, the power consumed by the driver IC 52 and the corresponding actuator unit 21 when the driver IC 52 outputs the flushing signal shown in FIG. 7B to all individual electrodes 135 of the actuator unit 21, is higher than the power consumed by the driver IC 52 and the actuator unit 21 when the driver IC 52 outputs the ejection signal shown in FIG. 7A, corresponding to the largest amount of ejected ink, to all individual electrodes 135 of the actuator unit 21. In this embodiment, therefore, as will be described later, in non-ejection flushing, the current flowing from the power supply unit 16 into the driver IC 52 is restricted so that the height of each voltage pulse contained in the flushing signal that the driver IC 52 actually outputs to each individual electrode 135 is lower than the height of each voltage pulse contained in the ejection signal shown in FIG. 7A.

Figure 8:
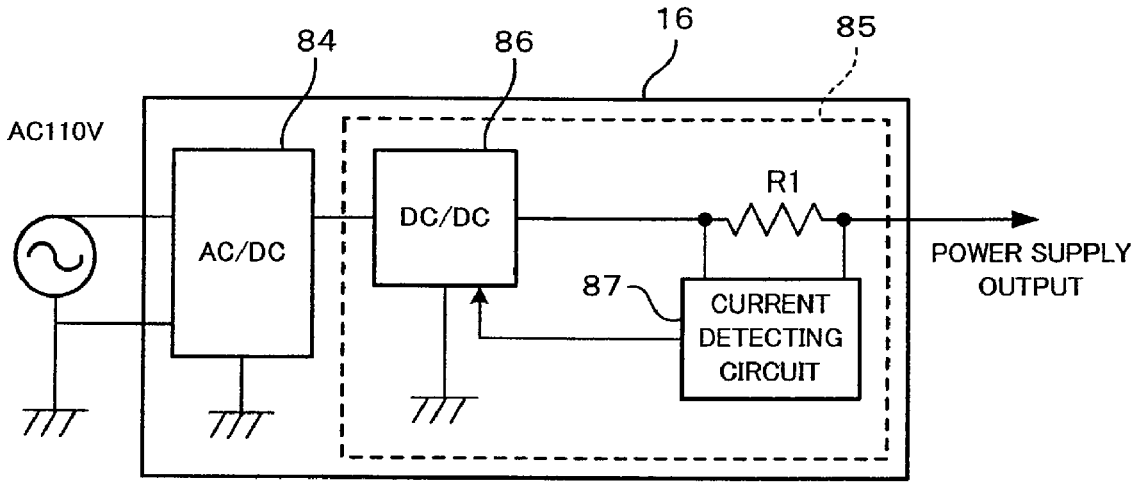
FIG. 8 is a block diagram of a power supply unit shown in FIG. 1.

Next, the power supply unit 16 will be described with reference to FIG. 8. The power supply unit 16 supplies power to the driver IC 52 of each inkjet head 1. As shown in FIG. 8, the power supply unit 16 includes therein an AC/DC converter 84 and a current restricting circuit 85. The AC/DC converter 84 converts alternate-current power supplied from an external power source, into direct-current power. In this embodiment, the AC/DC converter 84 converts AC 100 V supplied from the external power source, into DC 30 V. The direct-current power generated in the AC/DC converter 84 is supplied to the current restricting circuit 85. In a modification, the current restricting circuit 85 may be provided outside the power supply unit 16.

The current restricting circuit 85 restricts the value of current to flow from the power supply unit 16 into each driver IC 52, to a value not more than a predetermined upper limit current value. The current restricting circuit 85 includes therein a DC/DC converter 86, a current detecting circuit 87, and a resistance R1 for current detection. The DC/DC converter 86 is a switch type regulator that stabilizes the direct-current power output from the AC/DC converter 84, to DC 24 V to output. The direct-current power output from the DC/DC converter 86 is supplied to each driver IC 52 via the resistance R1. The current detecting circuit 87 measures the voltages at both ends of the resistance R1 to detect the value of the current output from the DC/DC converter 86. When the detected current value is larger than the predetermined upper limit current value, the current detecting circuit 87 outputs a stop signal to the DC/DC converter 86. When the current detecting circuit 87 outputs the stop signal, the DC/DC converter 86 stops the power supply. When the DC/DC converter 86 stops the power supply, the current detecting circuit 87 stops outputting the stop signal because the current detecting circuit 87 detects no current value larger than the upper limit current value. When the current detecting circuit 87 stops outputting the stop signal, the DC/DC converter 86 again starts the power supply. Thus, the current restricting circuit 85 forms a feedback circuit that inhibits the detected current value from exceeding the upper limit current value. Thereby, the current restricting circuit 85 substantially restricts the value of a current to flow from the power supply unit 16 into each driver IC 52, to a value not more than the upper limit current value. Thus, the current restricting circuit 85 functions as an overcurrent protective circuit.

The upper limit current value has been set so as to exceed the maximum value of current to flow into each driver IC 52 in normal printing, that is, the value of current to flow from the power supply unit 16 into each driver IC 52 when each driver IC 52 outputs the ejection signal as shown in FIG. 7A for ejecting the largest number of ink droplets, in this embodiment, three ink droplets, to all individual electrodes 135 in one printing cycle; and so as to be less than the value of current to flow from the power supply unit 16 into each driver IC 52 when each driver IC 52 outputs the flushing signal as shown in FIG. 7B to all individual electrodes 135.

In this embodiment, the maximum value of current to flow into each driver IC 52 in normal printing is 1 A. The value of current to flow into each driver IC 52 in non-ejection flushing is 2 A. Therefore, the upper limit current value has been set to 1.5 A. The value of the resistance R1 is 0.1 ohm. Therefore, when the voltage difference between both ends of the resistance R1 is not less than 150 mV, that is, the value of current to flow from the DC/DC converter 86 into each driver IC 52 is more than 1.5 A, the current detecting circuit 87 outputs a stop signal to the DC/DC converter 86. Because the current to flow into each driver IC 52 in non-ejection flushing is 2 A and each voltage pulse is 24 V, the resistance value in non-ejection flushing is 12 ohm. Therefore, when the value of current to flow into each driver IC 52 in non-ejection flushing is restricted to 1.5 A, the height of each voltage pulse to be output from the driver IC 52 is 12 ohm×1.5 A=18 V.

Figure 9:
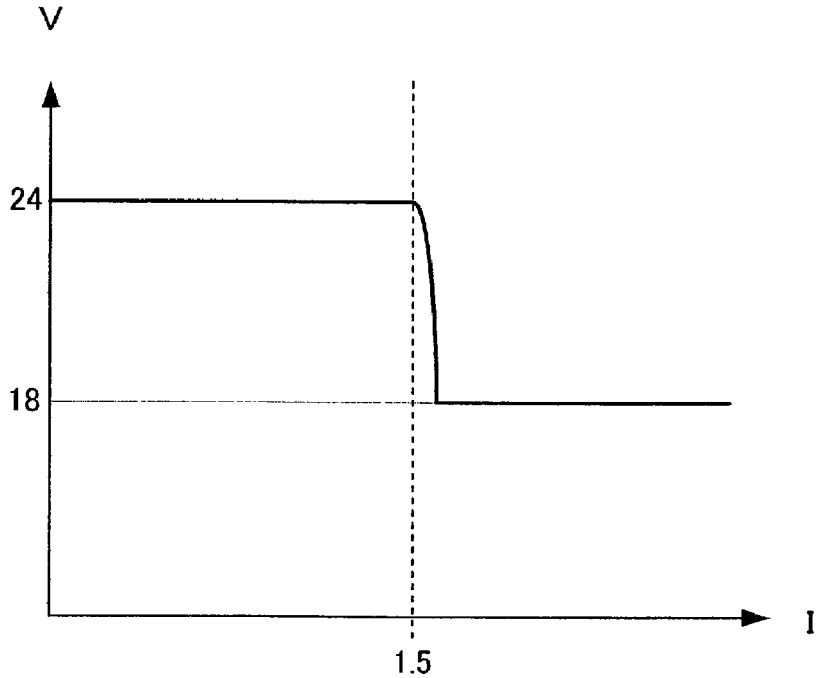
FIG. 9 is a graph showing a power supply characteristic of the power supply unit.
Figure 10A:
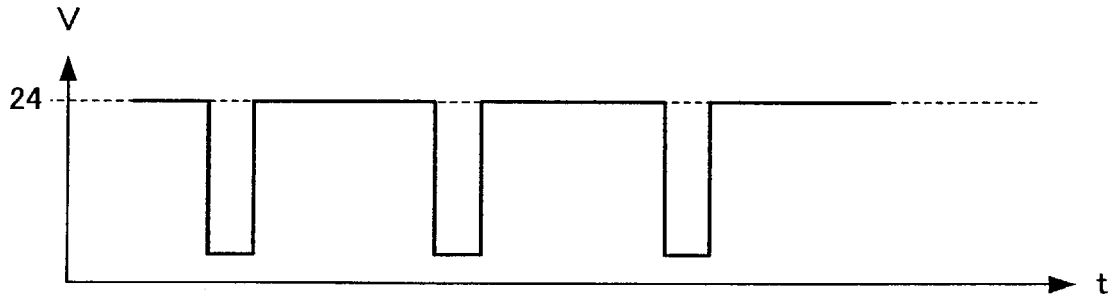
FIG. 10A is a timing chart showing an example of an ejection signal that the driver IC actually outputs.
Figure 10B:
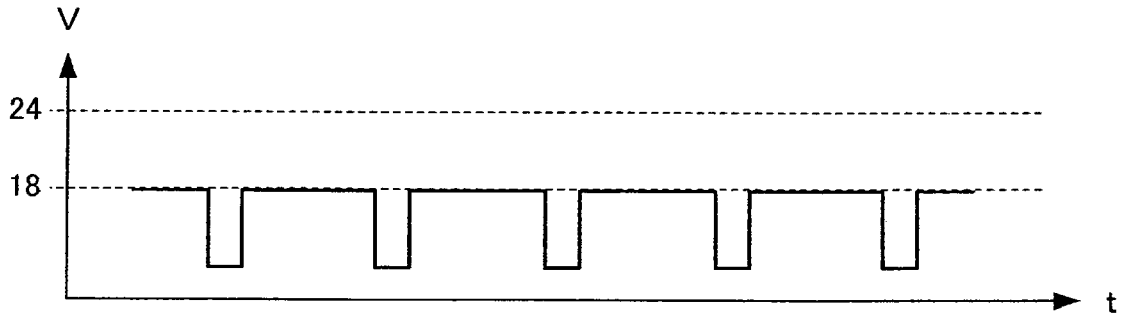
FIG. 10B is a timing chart showing a flushing signal that the driver IC actually outputs.

Next, an operation of the power supply unit 16 will be described with reference to FIGS. 9 and 10. FIG. 9 is a graph showing a power supply characteristic of the power supply unit 16. In FIG. 9, the axis of abscissas represents the current (A) to be output from the power supply unit 16, and the axis of ordinate represents the voltage (V) to be supplied from the power supply unit 16 to a driver IC 52. FIG. 10A shows an example of an ejection signal in one printing cycle that the driver IC 52 actually outputs, corresponding to FIG. 7A. FIG. 10B shows an example of a flushing signal that the driver IC 52 actually outputs, corresponding to FIG. 7B. As shown in FIG. 9, when the value of current to flow from the power supply unit 16 into the driver IC 52 is not more than the upper limit current value of 1.5 A, the voltage being supplied from the power supply unit 16 to the driver IC 52 is constant as 24 V. However, the value of current to flow from the power supply unit 16 into the driver IC 52 exceeds the upper limit current value of 1.5 A, the current restricting circuit 85 restricts the current to flow from the power supply unit 16 into the driver IC 52. Therefore, as described above, the voltage at this time is 18 V.

When the driver IC 52 outputs an ejection signal to each individual electrode 135 in normal printing, the maximum value of current flowing into the driver IC 52 is 1 A. Thus, the current restricting circuit 85 never restricts the current to flow from the power supply unit 16 into the driver IC 52. Therefore, the height of each voltage pulse contained in the ejection signal output from the driver IC 52 is constant as 24 V, as shown in FIG. 10A. On the other hand, when the driver IC 52 outputs a flushing signal to all individual electrodes 135 in non-ejection flushing, the value of current flowing into the driver IC 52 is 2 A. Thus, the current restricting circuit 85 restricts the current to flow from the power supply unit 16 into the driver IC 52, to a value not more than the upper limit current value of 1.5 A. Therefore, the height of each voltage pulse contained in the flushing signal output from the driver IC 52 lowers to 18 V, as shown in FIG. 10B. As a result, the corresponding actuator unit 21 is driven such that any ejection port 108 ejects no ink droplet, and the ink meniscus formed in each ejection port 108 oscillates. Thus, ink in each ejection port 108 is agitated without ejection.

In this embodiment, by non-ejection flushing, deterioration of ink ejection performance and defective ejections are suppressed without wasteful discharge of ink. In addition, when each driver IC 52 intends to output a flushing signal to all individual electrodes 135, the current restricting circuit 85 restricts the value of current to flow from the power supply unit 16 into the driver IC 52, to a value not more than the upper limit current value. This realizes power saving of the inkjet printer 101.

(First Modification)

Next will be described a first modification of the first embodiment. In the first modification, when all ejection ports 108 eject ink droplets in one printing cycle to form a so-called solid image that the whole of the printing region of a paper P has been daubed with ink, each driver IC 52 outputs to all individual electrodes 135 an ejection signal for making each ejection port 108 eject the second largest amount of ink, in other words, the second largest number of ink droplets, for example, two ink droplets when each ejection port 108 can eject any of one to three ink droplets. If the driver IC 52 outputs to at least one individual electrode 135 an ejection signal for making the corresponding ejection port 108 eject the second largest amount of ink when all ejection ports 108 eject ink droplets in one printing cycle, the driver IC 52 may output to the other individual electrodes 135 an ejection signal for making the corresponding ejection ports 108 eject the third or later largest amount of ink.

In non-ejection flushing, each driver IC 52 outputs to all individual electrodes 135 an ejection signal for making any ejection port 108 eject the largest amount of ink, in other words, the largest number of ink droplets. Thus, the power to be consumed by the driver IC 52 in non-ejection flushing, that is, the power to be supplied to each driver IC 52 when the driver IC 52 outputs to all individual electrodes 135 an ejection signal for ejecting the largest amount of ink, is higher than the power to be consumed by the driver IC 52 in normal printing.

The upper limit current value of the current restricting circuit 85 has been set to a value that exceeds the maximum value of current to flow into each driver IC 52 in normal printing, that is, the value of current to flow from the power supply unit 16 into each driver IC 52 when the driver IC 52 outputs to all individual electrodes 135 an ejection signal for making any ejection port 108 eject the second largest amount of ink in one printing cycle; and that is less than the value of current to flow from the power supply unit 16 into each driver IC 52 in non-ejection flushing. Thereby, when each driver IC 52 outputs to all individual electrodes 135 an ejection signal for ejecting the largest number of ink droplets for non-ejection flushing, the current restricting circuit 85 restricts the current to be supplied from the power supply unit 16 to the driver IC 52, to a value not more than the upper limit current value to lower the height of each voltage pulse contained in the ejection signal being output from the driver IC 52. Thus, because the height of each voltage pulse contained in the flushing signal is lowered when non-ejection flushing is performed, each actuator unit 21 decreases in the quantity of deformation. Therefore, the meniscus of ink formed in each ejection port 108 oscillates without any ejection port 108 ejecting ink droplets. Thus, ink in each nozzle is agitated without ejection.

In the above-described first modification, because the current restricting circuit 85 restricts the current to flow from the power supply unit 16 into each driver IC 52 when non-ejection flushing is performed, this realizes power saving of the inkjet printer 101. Further, because the current restricting circuit 85 that functions as an overcurrent protective circuit lowers the height of each voltage pulse to be output from each driver IC 52 in non-ejection flushing, the inkjet printer 101 has no need of, for example, a voltage control circuit that changes the voltage to be output from the DC/DC converter 86, so as to control the height of each voltage pulse, and a waveform generating circuit for generating a waveform for non-ejection flushing. This realizes a cost reduction of the inkjet printer 101.

(Second Modification)

Figure 11:
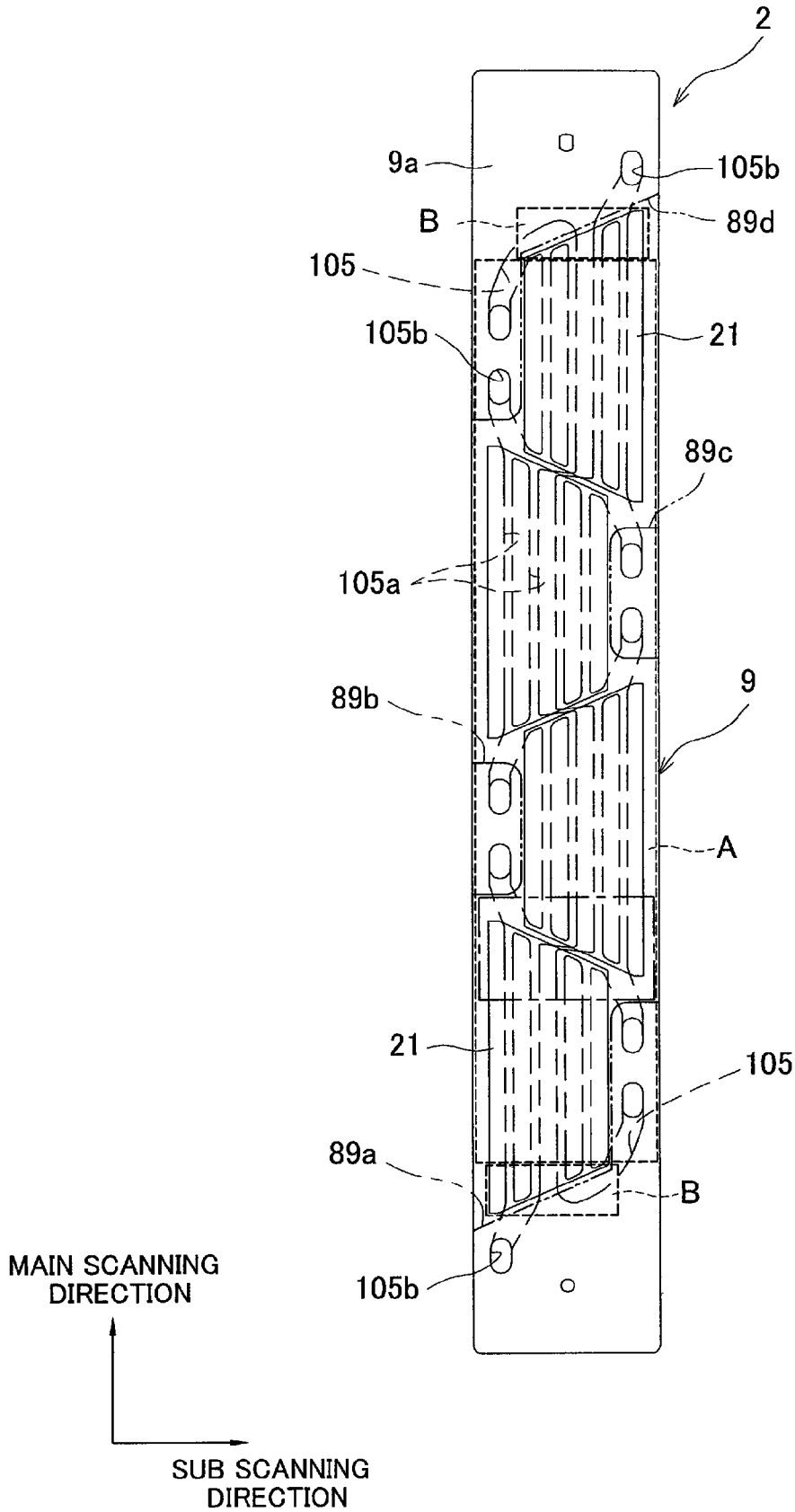
FIG. 11 is a plan view of a head main body of an inkjet printer according to a second modification of the first embodiment of the present invention.

Next, a second modification of the first embodiment will be described with reference to FIG. 11. FIG. 11 is a plan view of the same head main body 2 as of FIG. 3. An ejection region A and non-ejection regions B are formed in the ink ejection face 2*a* of the passage unit 9. The ejection region A is a region in which a plurality of ejection ports 108 are arranged longitudinally of the passage unit 9 at regular intervals corresponding to the printing resolution in the main scanning direction, that is, a region in which ejection ports 108 are formed that are to be opposed to the printing region of a paper P of the maximum size, in other words, a region in which ejection ports 108 are disposed that can eject ink droplets onto a paper P of the maximum size. The non-ejection regions B neighbor the ejection region A on both sides of the ejection region A longitudinal of the passage unit 9. In each non-ejection region B, a plurality of ejection ports 108 are arranged longitudinally of the non-ejection region B at irregular intervals. The non-ejection regions B correspond to respective right-triangular regions of two actuator units 21 disposed most outside longitudinally of the head main body 2, which regions do not face no other neighboring actuator units 21. The ejection ports 108 provided in the non-ejection regions B result from realization of a long head with four actuator units 21 of the head main body 4 being formed into the same shape. The ejection ports 108 do not directly contribute to printing on a paper P. However, by forming all actuator units 21 into the same shape, the manufacturing cost of the actuator units 21 can be reduced. In addition, because the operation performances of the actuator units 21 are uniformalized, this makes it hard to produce fluctuation in the ejection characteristics of ink droplets. Further, although individual ink passages 132 formed in the passage unit 9 so as to correspond to the non-ejection regions B do not directly contribute to printing on a paper P, the individual ink passages 132 has an advantage of making the rigidity of the passage unit 9 even.

In the second modification, in normal printing, each driver IC 52 outputs one of ejection signals selected in order in each printing cycle, to only the individual electrodes 135 corresponding to the ejection ports 108 in the ejection region A so that only the ejection ports 108 in the ejection region A eject ink droplets, in other words, the ejection ports 108 in the non-ejection regions B do not eject ink droplets. In non-ejection flushing, each driver IC 52 outputs an ejection signal for making the ejection ports 108 in the ejection region A and at least one, preferably, all, of the ejection ports 108 in the non-ejection regions B, eject the largest number of ink droplets, to the corresponding individual electrodes 135. Thus, the power to be consumed by each driver IC 52 in non-ejection flushing, that is, the power to be supplied from the power supply unit 16 to each driver IC 52 when the driver IC 52 outputs an ejection signal for ejecting the largest number of ink droplets, to all individual electrodes 135 corresponding to the ejection ports 108 in the ejection region A and the individual electrode 135 corresponding to at least one ejection port 108 in the non-ejection regions B as described above, is higher than the maximum power to be consumed by the driver IC 52 in normal printing, that is, the power to be supplied from the power supply unit 16 to each driver IC 52 when the driver IC 52 outputs an ejection signal for ejecting the largest number of ink droplets, to all individual electrodes 135 corresponding to only the ejection ports 108 in the ejection region A.

The upper limit current value of the current restricting circuit 85 has been set to a value that exceeds the maximum value of current to flow into each driver IC 52 in normal printing, that is, the value of current to flow from the power supply unit 16 into each driver IC 52 when the driver IC 52 outputs an ejection signal for making only the ejection ports 108 in the ejection region A eject the largest amount of ink in one printing cycle, to the individual electrodes 135 in the ejection region A; and that is less than the value of current to flow into each driver IC 52 in non-ejection flushing. Thereby, when each driver IC 52 outputs an ejection signal for ejecting the largest number of ink droplets, to all individual electrodes 135 corresponding to the ejection ports 108 in the ejection region A and the individual electrode 135 corresponding to at least one ejection port 108 in the non-ejection regions B as described above, for non-ejection flushing, the current restricting circuit 85 restricts the current to be supplied from the power supply unit 16 to the driver IC 52, to a value not more than the upper limit current value to lower the height of each voltage pulse contained in the ejection signal being output from the driver IC 52. Thus, because the height of each voltage pulse contained in the flushing signal is lowered when non-ejection flushing is performed, each actuator unit 21 decreases in the quantity of deformation. Therefore, the meniscus of ink formed in each ejection port 108 oscillates without any ejection port 108 ejecting ink droplets. Thus, ink in each nozzle is agitated without ejection.

In the above-described second modification, because the current restricting circuit 85 restricts the current to flow from the power supply unit 16 into each driver IC 52 when non-ejection flushing is performed, this realizes power saving of the inkjet printer 101. Further, because the current restricting circuit 85 that functions as an overcurrent protective circuit lowers the height of each voltage pulse to be output from each driver IC 52 in non-ejection flushing, the inkjet printer 101 has no need of, for example, a voltage control circuit that changes the voltage to be output from the DC/DC converter 86, so as to control the height of each voltage pulse, and a waveform generating circuit for generating a waveform for non-ejection flushing. This realizes a cost reduction of the inkjet printer 101.

Second Embodiment

Figure 12:
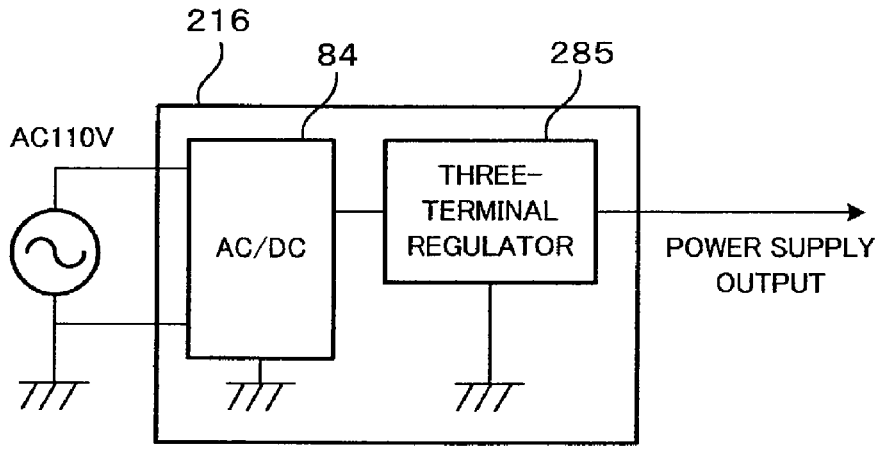
FIG. 12 is a block diagram of a power supply unit of an inkjet printer according to a second embodiment of the present invention.
Figure 13:
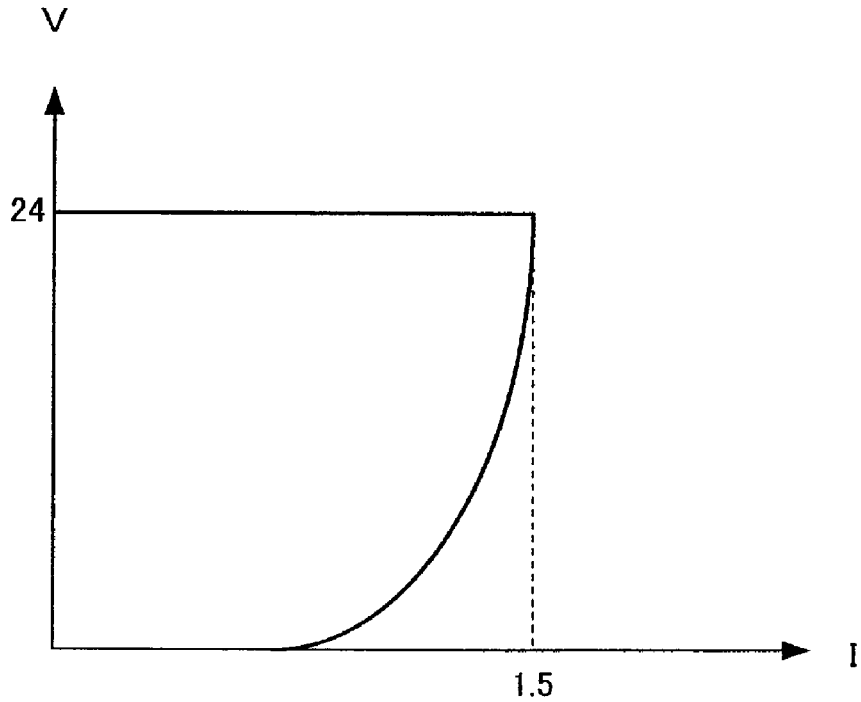
FIG. 13 is a graph showing a power supply characteristic of the power supply unit shown in FIG. 12.

Next, an inkjet printer according to a second embodiment of the present invention will be described with reference to FIGS. 12 and 13. FIG. 12 is a block diagram of a power supply unit 216 included in the inkjet printer of this embodiment. FIG. 13 is a graph showing a power supply characteristic of the power supply unit 216. In FIG. 13, the axis of abscissas represents the current (A) to be output from the power supply unit 216, and the axis of ordinate represents the voltage (V) to be supplied from the power supply unit 216 to a driver IC 52. This embodiment differs from the first embodiment only in the construction of the power supply unit. The other components of this embodiment are substantially the same as those of the first embodiment. Therefore, only the power supply unit 216 will be described below in detail, and the same components as in the first embodiment are denoted by the same reference numerals as in the first embodiment, respectively, to omit the description thereof.

The power supply unit 216 supplies power to the driver IC 52 of each inkjet head 1. As shown in FIG. 12, the power supply unit 216 includes therein an AC/DC converter 84 and a three-terminal regulator 285. The three-terminal regulator 285 includes therein a current restricting circuit. The AC/DC converter 84 converts alternate-current power supplied from an external power source, into direct-current power. The direct-current power generated in the AC/DC converter 84 is supplied to the three-terminal regulator 285. The three-terminal regulator 285 stabilizes the power supply output, and restricts the value of current to be supplied from the power supply unit 216 to each driver IC 52, to a value not more than a predetermined upper limit current value. Thus, the three-terminal regulator 285 also functions as an overcurrent protective circuit. In this embodiment, the three-terminal regulator 285 stabilizes the power supply output to 24 V. The upper limit current value has been determined to 1.5 A.

As shown in FIG. 13, when the value of current to flow from the power supply unit 216 into a driver IC 52 is not more than the upper limit current value of 1.5 A, the voltage to be supplied from the power supply unit 216 is constant as 24 V. However, when the value of current to flow from the power supply unit 216 into the driver IC 52 exceeds the upper limit current value of 1.5 A, the three-terminal regulator 285 restricts the current to flow from the power supply unit 216 into the driver IC 52. The three-terminal regulator 285 has a characteristic that the voltage exponentially decreases as the current to output decreases when the current restriction has been once started.

When each driver IC 52 outputs to all individual electrodes 135 an ejection signal, for example, the ejection signal shown in FIG. 7A, for normal printing, the maximum value of current to flow into the driver IC 52 is 1 A. Thus, the three-terminal regulator 285 never restricts the current to flow from the power supply unit 216 into the driver IC 52. Therefore, the height of each voltage pulse contained in the ejection signal output from the driver IC 52 is constant as 24 V, as shown in FIG. 10A. On the other hand, when each driver IC 52 intends to output a flushing signal, for example, as shown in FIG. 7B, to all individual electrodes 135 for non-ejection flushing, the value of current flowing from the power supply unit 216 into the driver IC 52 will become 2 A. Thus, the three-terminal regulator 285 restricts the value of current to flow from the power supply unit 216 into the driver IC 52. Therefore, the height of each voltage pulse contained in the flushing signal output from the driver IC 52 lowers as shown in FIG. 10B. As a result, the corresponding actuator unit 21 is driven such that any ejection port 108 ejects no ink droplet, and the ink meniscus formed in each ejection port 108 oscillates. Thus, ink in each ejection port 108 is agitated without ejection.

In this embodiment, by non-ejection flushing, deterioration of ink ejection performance and defective ejections are suppressed without wasteful discharge of ink. In addition, when each driver IC 52 intends to output a flushing signal to all individual electrodes 135, the three-terminal regulator 285 restricts the current to flow from the power supply unit 216 into the driver IC 52, to a value not more than the upper limit current value. This realizes power saving of the inkjet printer 101. Further, the use of such an inexpensive three-terminal regulator 285 brings about a cost reduction of the inkjet printer.

Third Embodiment

Figure 14:
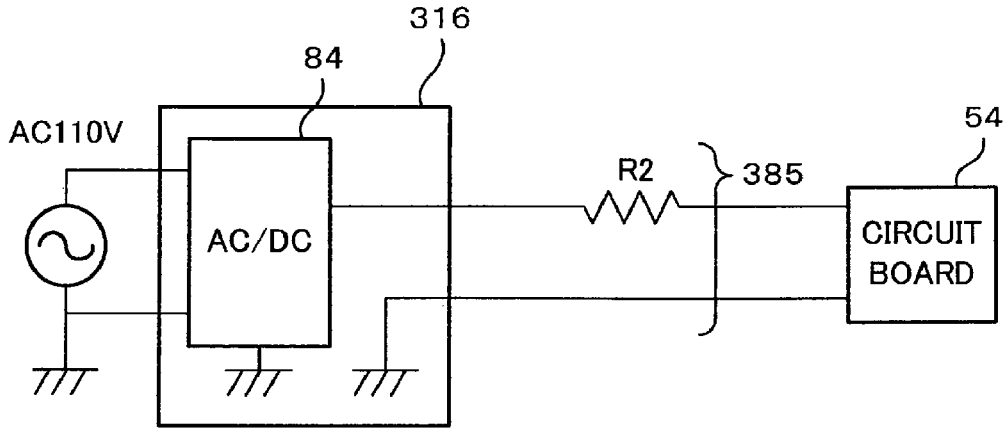
FIG. 14 is a block diagram of a power supply unit and its periphery of an inkjet printer according to a third embodiment of the present invention.
Figure 15:
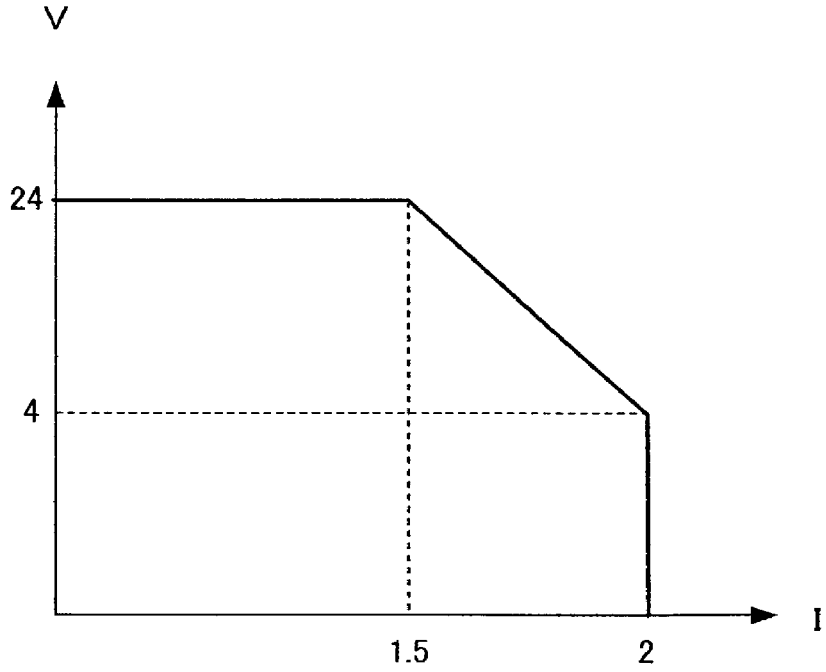
FIG. 15 is a graph showing a characteristic of power to be supplied to a driver IC from the power supply unit shown in FIG. 14.

Next, an inkjet printer according to a third embodiment of the present invention will be described with reference to FIGS. 14 and 15. FIG. 14 is a block diagram of a power supply unit 316 and its periphery included in the inkjet printer of this embodiment. FIG. 15 is a graph showing a characteristic of the power to be supplied from the power supply unit 316 to a driver IC 52. In FIG. 15, the axis of abscissas represents the current (A) to be output from the power supply unit 316 into the driver IC 52, and the axis of ordinate represents the voltage (V) to be supplied from the power supply unit 316 to the driver IC 52. This embodiment differs from the first embodiment only in the construction of the power supply unit. The other components of this embodiment are substantially the same as those of the first embodiment. Therefore, only the power supply unit 316 will be described below in detail, and the same components as in the first embodiment are denoted by the same reference numerals as in the first embodiment, respectively, to omit the description thereof.

As shown in FIG. 14, the power supply unit 316 includes therein an AC/DC converter 84. The AC/DC converter 84 converts alternate-current power supplied from an external power source, into direct-current power. The direct-current power generated in the AC/DC converter 84 is supplied to a driver IC 52 via a cable 385, as a power line, and a circuit board 54. Although the cable 385 is shown in FIG. 14 as a cable to connect the power supply unit 316 to the circuit board 54, the cable 385 includes wires formed on a COF 50 connecting the circuit board 54 to the driver IC 52. The cable 385 is formed integrally with a not-shown signal line such as a flat flexible cable to output a control signal to the driver IC 52. In a modification, however, the cable 385 may be provided separately from the signal line to output a control signal to the driver IC 52. The cable 385 includes an internal resistance R2. The value of the internal resistance R2 has been determined so that the voltage to be supplied to the driver IC 52 decreases to a value by which the corresponding actuator unit 21 is driven such that any ejection port 108 does not eject ink droplets, when the value of current to flow from the power supply unit 316 into the driver IC 52 exceeds an upper limit current value.

As shown in FIG. 15, when the value of current to flow from the power supply unit 316 into the driver IC 52 is not more than the upper limit current value of 1.5 A, the voltage to be supplied to the driver IC 52 is constant as 24 V. However, when the value of current to flow from the power supply unit 316 into the driver IC 52 exceeds the upper limit current value of 1.5 A, the voltage to be supplied to the driver IC 52 lowers due to the internal resistance R2 of the cable 385. For example, when the value of the internal resistance R2 is 2 ohm, the driving voltage becomes 4 V in non-ejection flushing because a current of 2 A intends to flow in the cable 385.

When each driver IC 52 outputs an ejection signal to all individual electrodes 135 for normal printing, the value of current to flow into the driver IC 52 is 1 A at the maximum. Thus, the current to be supplied to the driver IC 52 never lowers due to the internal resistance R2 of the cable 385. Therefore, the height of each voltage pulse contained in the ejection signal output from the driver IC 52 is constant as 24 V, as shown in FIG. 10A. On the other hand, when each driver IC 52 intends to output a flushing signal, for example, as shown in FIG. 7B, to all individual electrodes 135 for non-ejection flushing, the value of current flowing from the power supply unit 316 into the driver IC 52 will become 2 A. Thus, the current to be supplied to the driver IC 52 lowers due to the internal resistance R2 of the cable 385 so that the height of each voltage pulse contained in the flushing signal output from the driver IC 52 lowers as shown in FIG. 10B. As a result, the corresponding actuator unit 21 is driven such that any ejection port 108 ejects no ink droplet, and the ink meniscus formed in each ejection port 108 oscillates. Thus, ink in each ejection port 108 is agitated without ejection. In this embodiment, by non-ejection flushing, deterioration of ink ejection performance and defective ejections are suppressed without wasteful discharge of ink.

In addition, when each driver IC 52 intends to output a flushing signal to all individual electrodes 135, the height of each voltage pulse contained in the flushing signal to be output from the driver IC 52 lowers due to the internal resistance R2 of the cable 385. This realizes power saving of the inkjet printer 101. Further, because no voltage control circuit for controlling the height of each voltage pulse is required, this realizes a cost reduction of the inkjet printer.

Further, because the cable 385 is formed integrally with the signal line to output a control signal to the driver IC 52, this realizes a cost reduction of the cable 385.

(Other Modifications)

In the above-described first to third embodiments, each actuator unit 21 is a unimorph piezoelectric type. However, another type of an actuator may be used if the actuator is driven by voltage pulses so that the drive quantity changes in accordance with the heights of the voltage pulses. The present invention can be applied to not only an inkjet recording apparatus having an ejection energy applier of a piezoelectric type actuator unit including a piezoelectric layer, but also a thermal type apparatus in which each individual electrode serves as a heater to heat ink.

In a modification of the above-described third embodiment, as described in the first modification of the first embodiment, each driver IC 52 may output to all individual electrodes 135 an ejection signal for making each ejection port 108 eject the second largest amount of ink in normal printing, and may output to all individual electrodes 135 an ejection signal for making any ejection port 108 eject the largest amount of ink in non-ejection flushing.

In another modification of the above-described third embodiment, as described in the second modification of the first embodiment, each driver IC 52 may output one of ejection signals to only the individual electrodes 135 corresponding to the ejection ports 108 in the ejection region A, in normal printing, and may output an ejection signal for making the ejection ports 108 in the ejection region A and at least one, preferably, all, of the ejection ports 108 in the non-ejection regions B, eject the largest number of ink droplets, to the corresponding individual electrodes 135, in non-ejection flushing.

In either of the above-described two modifications, the internal resistance R2 has been adjusted to a value that controls the height of each voltage pulse to a value by which the corresponding actuator unit 21 is driven such that any ejection port 108 does not eject ink droplets.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet recording apparatus comprising:

a conveyance mechanism which conveys a recording medium;

a passage unit including therein a plurality of individual ink passages each of which leads from an outlet of a common ink chamber through a pressure chamber to a nozzle;

an ejection energy applier which gives ejection energy to ink in a plurality of the pressure chambers of the passage unit, the applier including a plurality of individual electrodes related to the respective pressure chambers;

a waveform outputting circuit which outputs to each individual electrode one of a plurality of ejection signals and a flushing signal selected in order in each printing cycle, which is defined by a time period necessary for conveying the printing medium by unit distance corresponding to a printing resolution of an image to be formed on the recording medium, the plurality of ejection signals containing the different numbers of voltage pulses to drive the ejection energy applier, the numbers of voltage pulses corresponding to a plurality of amounts of ink to be ejected from each nozzle in one printing cycle, respectively, the flushing signal containing a plurality of voltage pulses each having a width smaller than that of any voltage pulse containing in the ejection signals, and arranged at smaller intervals than a plurality of voltage pulses containing in any ejection signals so that any nozzle does not eject an ink droplet;

a power supply unit which supplies power to the waveform outputting circuit; and a current restricting circuit which restricts a current to flow from the power supply unit into the waveform outputting circuit so that the value of the current to flow from the power supply unit into the waveform outputting circuit is not more than an upper limit current value which has been determined so as to exceed a value of the current to flow from the power supply unit into the waveform outputting circuit when the waveform outputting circuit outputs to all individual electrodes an ejection signal corresponding to the largest amount of ink to eject, and so as to be less than a value of the current to flow from the power supply unit into the waveform outputting circuit when the waveform outputting circuit outputs, to all individual electrodes, the flushing signal, whose voltage pulse level is equal to that of the ejection signals, wherein the power consumed by the waveform outputting circuit when the waveform outputting circuit outputs the flushing signal to all individual electrodes, is higher than the power consumed by the waveform outputting circuit when the waveform outputting circuit outputs, to all individual electrodes, an ejection signal whose voltage pulse level is equal to that of the flushing signal, the ejection signal corresponding to the largest amount of ejected ink, and the current restricting circuit never restricts the current to flow from the power supply unit to the waveform outputting circuit, when the waveform outputting circuit outputs to all the individual electrodes the ejection signal corresponding to the largest amount of ejected ink, and restricts the current to flow from the power supply unit to the waveform outputting circuit, to a value not more than the upper limit current value, when the waveform outputting circuit outputs the flushing signal to all the individual electrodes.

2. The apparatus according to claim 1, wherein the current restricting circuit includes a three-terminal regulator.

3. An inkjet recording apparatus comprising:

a conveyance mechanism which conveys a recording medium;

a passage unit including therein a plurality of individual ink passages each of which leads from an outlet of a common ink chamber through a pressure chamber to a nozzle;

an ejection energy applier which gives ejection energy to ink in a plurality of the pressure chambers of the passage unit, the applier including a plurality of individual electrodes related to the respective pressure chambers;

a waveform outputting circuit which outputs to each individual electrode one of a plurality of ejection signals and a flushing signal selected in order in each printing cycle, which is defined by a time period necessary for conveying the printing medium by unit distance corresponding to a printing resolution of an image to be formed on the recording medium, the plurality of ejection signals containing the different numbers of voltage pulses to drive the ejection energy applier, the numbers of voltage pulses corresponding to a plurality of amounts of ink to be ejected from each nozzle in one printing cycle, respectively, the flushing signal containing a plurality of voltage pulses each having a width smaller than that of any voltage pulse containing in the ejection signals, and arranged at smaller intervals than a plurality of voltage pulses containing in any ejection signals so that any nozzle does not eject an ink droplet;

a power supply unit which supplies power to the waveform outputting circuit; and a power line having an internal resistance, which connects the power supply unit with the waveform outputting circuit, wherein the power consumed by the waveform outputting circuit when the waveform outputting circuit outputs the flushing signal to all individual electrodes, is higher than the power consumed by the waveform outputting circuit when the waveform outputting circuit outputs, to all individual electrodes, an ejection signal whose voltage pulse level is equal to that of the flushing signal, the ejection signal corresponding to the largest amount of ejected ink, the internal resistance restricts a current to flow from the power supply unit into the waveform outputting circuit so that the value of the current to flow from the power supply unit into the waveform outputting circuit is not more than an upper limit current value which has been determined so as to exceed a value of the current to flow from the power supply unit into the waveform outputting circuit when the waveform outputting circuit outputs to all individual electrodes an ejection signal corresponding to the largest amount of ink to eject, and so as to be less than a value of the current to flow from the power supply unit into the waveform outputting circuit when the waveform outputting circuit outputs, to all individual electrodes, the flushing signal whose voltage pulse level is equal to that of the ejection signals, the internal resistance never restricts the current to flow from the power supply unit to the waveform outputting circuit, when the waveform outputting circuit outputs to all the individual electrodes the ejection signal corresponding to the largest amount of ejected ink, and restricts the current to flow from the power supply unit to the waveform outputting circuit, to a value not more than the upper limit current value, so that each voltage pulse contained in the flushing signal has a height by which the ejection energy applier is driven without any nozzle ejecting an ink droplet, when the waveform outputting circuit outputs the flushing signal to all individual electrodes.

4. The apparatus according to claim 3, wherein the power line has the same shape as a signal line through which a signal is output to the waveform outputting circuit.

5. The apparatus according to claim 1, wherein:

the current restricting circuit further includes a resistance, and a current detecting circuit which detects a current supplied to the waveform outputting circuit through the resistance, and the current restricting circuit restricts the current to be supplied to the waveform outputting circuit to a value not more than the upper limit current value, by stopping the power supply to the waveform outputting circuit, when the current detecting circuit detects a current at a value which is equal to or more than the upper limit current value, and by resuming the power supply to the waveform outputting circuit, when the current detecting circuit no longer detects a current at a value which is equal to or more than the upper limit current value, after the power supply to the waveform outputting circuit has been stopped.

6. The apparatus according to claim 1, wherein:

the current restricting circuit includes a three-terminal regulator which outputs a current to be supplied to the waveform outputting circuit, and wherein when the value of current to flow from the power supply unit into the waveform outputting circuit exceeds the upper limit current value, the three-terminal regulator starts restricting the current, and decreases the voltage exponentially as the current decreases.

* * * * *